US005439211A

United States Patent [19]

Drabowsky

[11] Patent Number: 5,439,211

[45] Date of Patent: Aug. 8, 1995

[54] TARGET TRAINING SYSTEM AND METHOD FOR BASEBALL PITCHERS

[75] Inventor: Moe Drabowsky, 4741 Oak Run Dr., Sarasota, Fla. 34243

[73] Assignee: Moe Drabowsky, Sarasota, Fla.

[21] Appl. No.: 332,937

[22] Filed: Nov. 1, 1994

[51] Int. Cl.[6] ..... A63B 69/00

[52] U.S. Cl. ..... 273/26 A

[58] Field of Search ..... 273/26 A

[56] References Cited

U.S. PATENT DOCUMENTS

| | | | |
|---|---|---|---|
| 1,511,430 | 10/1924 | Schonberg | 273/26 A |
| 1,567,384 | 12/1925 | Rectenwald et al. | 273/26 A |
| 1,652,062 | 12/1927 | Stauffer | 273/26 A |
| 3,312,467 | 4/1967 | Dawson | 273/26 A |
| 4,199,141 | 4/1980 | Garcia | 273/26 A |
| 4,254,952 | 3/1981 | Playter, Jr. | 273/26 A |
| 4,344,621 | 8/1982 | Baker | 273/26 A |
| 4,415,154 | 11/1983 | Engelhardt | 273/26 A |
| 4,473,227 | 9/1984 | Klaus | 273/26 A |
| 4,497,485 | 2/1985 | Macosko | 273/26 A |
| 4,643,423 | 2/1987 | Wright | 273/26 A |
| 4,657,250 | 4/1987 | Newland et al. | 273/26 A |
| 4,930,774 | 6/1990 | Butcher | 273/26 A |
| 5,046,729 | 9/1991 | Yancey | 273/26 A |
| 5,064,194 | 11/1991 | Bixler et al. | 273/26 A |
| 5,083,774 | 1/1992 | Yalvac | 273/26 A |

*Primary Examiner*—William H. Grieb

*Attorney, Agent, or Firm*—Hill, Steadman & Simpson

[57] ABSTRACT

A target training system and method for baseball pitchers employs a target sheet mounted on a supporting structure so that a facing surface of the target sheet is vertical and a bottom of the target sheet is at ground level. Hitter shoulder level, waist level, and knee level lines are provided on the facing surface of the target sheet. First and second vertical boundary lines running from a top to a bottom of the sheet indicate a width of a strike zone. A plurality of boxes of differing colors and having differing sequencing indicia representing relatively high quality pitches are arranged in and around the strike zone. Regions having a white color within and near the strike zone and exclusive of the colored boxes are provided, the regions being exclusionary zones representing relatively poor quality pitches. Some of the boxes are subdivided to permit pitching to progressively smaller targets. Separate target sheets are provided for different skill levels.

28 Claims, 1 Drawing Sheet

TARGET TRAINING SYSTEM AND METHOD FOR BASEBALL PITCHERS

BACKGROUND OF THE INVENTION

1. Field of the Invention

The present invention relates to a training system for baseball pitchers.

2. Description of the Prior Art

It has been previously known to provide a practice target for baseball pitchers. In U.S. Pat. No. 1,511,430, a baseball pitchers' practice target comprises a panel of flexible material having a baseball catcher illustrated thereon and a rectangular box superimposed on the figure of the catcher delineating a strike zone.

In U.S. Pat. No. 4,254,952 a pitching practice device is provided formed of a sheet having a central portion divided into a plurality of sections each providing an opening through the sheet. A canvas chute is provided behind the sheet to catch the balls passing through the openings. The sheet aperture is divided into zones for indicating whether a pitched ball is high, low, inside, outside, or down the middle.

In U.S. Pat. No. 5,046,729 a baseball pitchers' practice target is formed of a matrix of spring loaded panels which activate switches. The switches turn on various colored lamps when the panels are struck by a baseball.

The aforementioned devices have the disadvantage that they do not impress upon the baseball pitcher employing the target device the importance of avoiding selected zones in and around the strike zone. Furthermore, it is a disadvantage of the prior art systems that they are inflexible in their use, since the target areas are part of a regular geometrical pattern, and they are not adaptable for progressively improving a pitcher's skill in avoiding certain zones within or near the strike zone while concentrating on the ability to hit certain other regions which represent quality pitches. Furthermore, they are not adaptable for progressive training techniques to accommodate and promote improvements in the pitcher's accuracy during use of the system.

It is a further disadvantage of the prior art systems that it is difficult for a coach to communicate to the baseball pitcher who is using the system the precise areas or regions to be pitched to achieve quality pitching.

It is another disadvantage of the prior art systems that they are not adaptable to the various levels of pitching skill, such as professional major league pitchers, high school or college level pitchers, and little league pitchers.

SUMMARY OF THE INVENTION

It is an object of the invention to improve on the above described prior art systems.

It is a further object of the invention to develop a pitcher's skill through impressing on the pitcher the importance of avoiding certain exclusion zones in and around the strike zone.

It is another object of the invention to provide a system which is useful for a progressive training method so that as a pitcher's skill increases, without changing the target area, smaller zones can be identified consistent with high quality pitching and an advanced level of pitching.

It is another object of the invention to provide a system and method which is readily adaptable for professional major league, high school and college level, and little league pitchers.

Finally, it is an object of the invention to provide a training system and method which allows a pitching coach to instruct a pitcher in a simple and straightforward manner while the pitcher is using the target system.

According to the invention, a flexible sheet in the form of a rectangle is provided. The sheet has indicia thereon indicating shoulder level, waist level, and knee level for a typical hitter. Vertical boundary stripes defining the width of home plate indicative of the strike zone are provided on the sheet. A plurality of differently colored boxes are also provided on the sheet in and around the strike zone. External to these boxes are regions of a same color which, above the knee level indicia and between the vertical strike zone boundary stripes define exclusion zones within, and in some cases near, the strike zone which are to be avoided to achieve quality pitching. Furthermore, numbers and in some cases letters, useful for identification and sequence training, are provided within the boxes.

According to the system and method of the invention, by calling out either colors or numbers or a combination thereof, a pitching coach can communicate to a pitcher boxes to be pitched to corresponding to quality pitches. Furthermore, the exclusion zones within the strike zone are apparent to the pitcher, since they are of a constant color different than the colors of the boxes, such as preferably plain white.

With the system and method of the invention, the pitcher acquires both improved control and command over his pitches. Furthermore, in view of the numbering system, a pitching training sequence can be easily implemented as part of the training method by calling out a series of different numbers to the pitcher. Furthermore, since boxes outside the strike zone can be of a same color such as green, it is easy for the pitcher to identify by color those zones which, when pitched to, would constitute a ball rather than a strike.

Furthermore, since certain of the boxes are internally divided into smaller boxes, a pitching sequence and progression for improved control and command results, since as the pitcher's control improves, he can aim for the smaller sub-divisions of the boxes, where previously he was pitching to the entire box.

The sheet having the target indicia thereon is both flexible and durable, and is preferably mounted on a padded vertical surface, such as padding on a wall in a baseball field. Alternatively, the target sheet can be mounted on the vertical face of a screen supported by a support structure.

With the method and system of the invention, the colored boxes represent quality pitching locations whereas the plain constant color within the strike zone, and in some cases near the strike zone, represent exclusion zones to be avoided.

DESCRIPTION OF THE PREFERRED EMBODIMENTS

Figure 1:
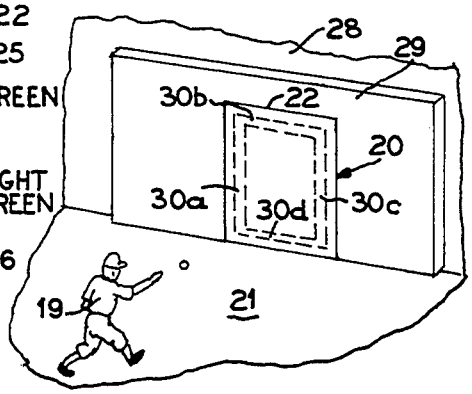
FIG. 1 is a perspective view of the target training system and method for baseball pitchers according to the present invention during use, and wherein the target is mounted on a padded wall.

FIG. 1 shows the target training system 20 of the invention mounted on a front vertical face of a padding 29 mounted on a wall 28, such as the outfield wall in a baseball park. A pitcher 19 is illustrated throwing towards the flexible target sheet 22 mounted to the front surface of the padding 29, preferably by velcro strips 30*a*, 30*b*, 30*c*, 30*d*. The target sheet 22 has its bottom edge aligned with the upper surface of the ground 21.

Preferably the flexible target sheet 22 is formed of a strong durable material which can withstand the pounding of the baseball hitting the target. A polyurethane coated woven fabric such as nylon is preferably employed. Tyvek of the DuPont Corporation is particularly adapted for this application. Alternatively, a canvas sheeting or a polyester fabric may be employed of sufficient strength to withstanding the pounding of the pitched balls without tearing occurring.

Figure 2:
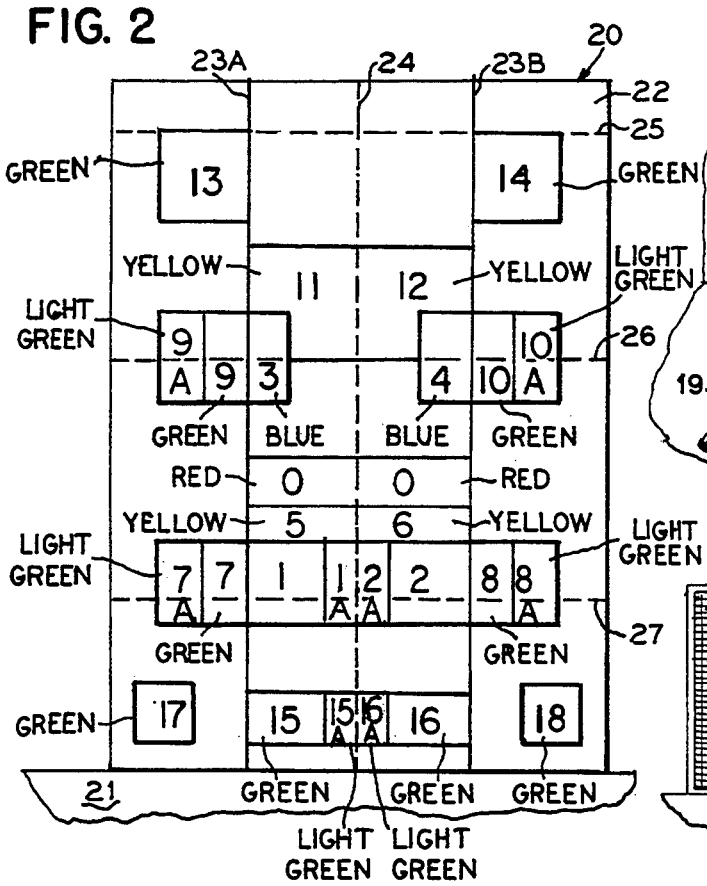
FIG. 2 is a front view of the target sheet of the invention for primary use by professional major league pitchers or minor league pitchers striving to reach the major leagues.

Referring to FIG. 2, the major league or professional level target sheet 22 having various target indicia thereon is generally indicated at 20. The indicia are preferably sewn onto the front face of the target sheet in the form of fabric boxes. Alternatively, the target boxes and/or other indicia can be printed on the face of the fabric sheet.

To define the outer limits of home plate and thus the outer limits of the strike zone, strike zone vertical boundary stripes 23*a* and 23*b* run the entire length vertically on the face of the target sheet. Down the middle of the sheet a dashed center line 24 is provided.

A typical hitter's shoulder level is indicated by dashed line 25. The hitter waist level is indicated by dashed line 26. The hitter knee level is indicated by dashed line 27.

The definition of a strike zone may change depending on the level of baseball involved and/or the umpire who is making calls. For example, the strike zone might be defined from below the shoulder level line 25 at the top, down to the knee level line 27 at the bottom, and at the left and right sides by the vertical boundary sides 23*a* and 23*b*. Of course, other criteria for the strike zone might be employed depending on the level involved or the umpire.

All of the colored boxes represent quality pitches. For example, the shoulder level line 25, green boxes 13 and 14 indicate a pitching target for shoulder level balls. Boxes 11 and 12 are colored yellow and indicate quality pitches within the strike zone. Boxes 9*a* and 10*a* are preferably colored light green, and boxes 9 and 10 are preferably colored green. These green boxes indicate balls which are also quality pitches. Boxes 3 and 4 are colored blue and indicate quality pitches just inside the strike zone.

The purpose of the boxes on the target sheet is to provide regions for a pitcher to aim for which are considered quality pitches. Areas which are uncolored such as preferably white zones lying outside the colored boxes and within or near the strike zone would represent exclusionary zones which a pitcher should preferably not pitch to, since such a pitch would represent a low quality pitch easily hit by a typical hitter.

It should further be appreciated by observance of the sub-division of the boxes 9 and 9*a* and 10 and 10*a* that as a pitcher's command and control level increases, that while he might initially pitch for the region indicated by the combination of boxes 9 and 9*a* (green and light green), the pitching coach or the pitcher himself may decide to narrow down the target region for progressive training to a smaller sub-division box such as 9*a* or 10*a*.

What was said above for those boxes already described is equally true for the other colored boxes shown in FIG. 2 on the flexible target 22, including the colored boxes labelled 0, 5, 6, 7*a*, 7, 1, 1*a*, 2*a*, 2, 8, 8*a*, 17, 15, 15*a*, 16*a*, 16, and 18.

It may be observed that those boxes which are either green or light green are all balls, whereas those boxes having the colors yellow, blue, red, and gray all potentially lie within the strike zone.

Figure 3:
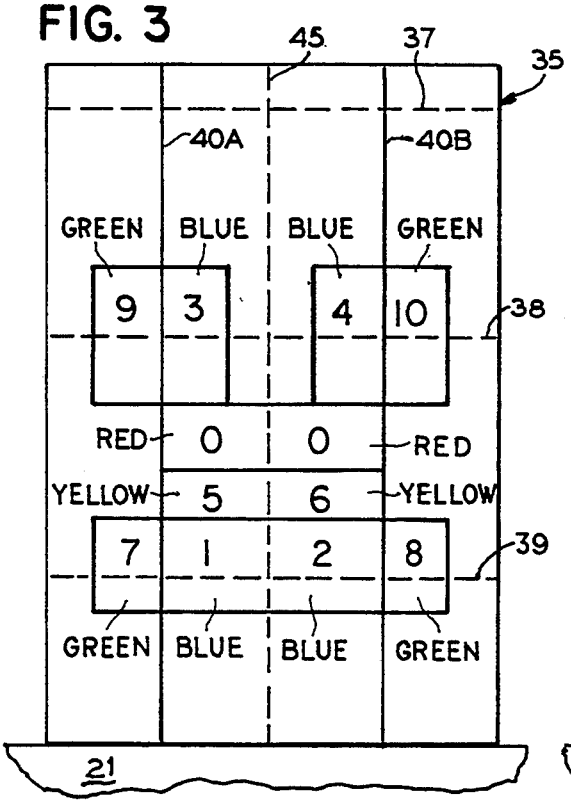
FIG. 3 is a front view of the target sheet of the invention primarily used by high school and college pitchers.

FIG. 3 shows a version of the flexible target system of the invention useful primarily for high school and college pitchers. It can be seen that the height of the target is the same as the major league version (preferably 60 inches). However, the width of the target sheet is slightly less and is preferably about 40 inches compared to the width of the major league pro model having a width of 44 inches. The shoulder level dashed line 35, waist level line 38, and knee level line 39 in FIG. 3 are at the same height relative to the ground 21 as in the case of the major league model shown in FIG. 2. A dashed center line 45 is also provided.

As can be seen, the box 9 in the high school and college level target of FIG. 3 is larger than the box 9 in the pro model, and is slightly smaller than the combination of boxes 9 and 9*a* in the pro model of FIG. 2. Thus, for the college and high school level, the boxes are somewhat larger with fewer sub-divisions. It should be noted, however, that the same general coloring scheme is employed with green representing zones to be pitched to representing balls outside the strike zone, whereas the colors blue, red, and yellow represent pitching targets within the strike zone. Furthermore, the same concept of exclusionary zones which are preferably white and lying outside the boxes also exists in the version of the target sheet shown in FIG. 3.

It should further be noted that the numbering scheme is consistent with the numbering scheme for the boxes in the pro level model of FIG. 2.

Figure 4:
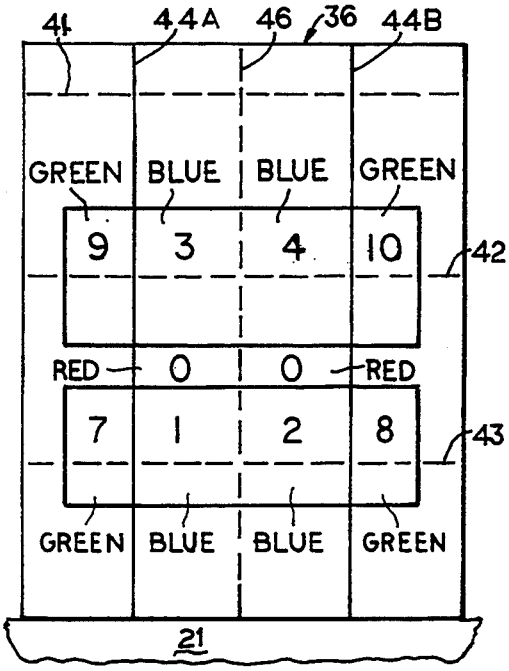
FIG. 4 is a front view of the target sheet of the invention primarily useful for little league pitchers.

FIG. 4 shows the little league version of the target which is the same width as the high school and college version shown in FIG. 3, but is of a shorter overall height, preferably about 50 inches. Furthermore, the shoulder level dashed line 41, waist level dashed line 42, and knee level dashed line 43 are progressively lower in FIG. 4 to accomodate shorter hitters at the little league level. Furthermore, generally larger boxes are provided so that the little league pitchers have large target zones more appropriate to their skill level. It should be noted, however, that the same general numbering scheme and color scheme is utilized in the little league target system of FIG. 4 as was employed in the FIG. 3 and FIG. 2 higher skill level versions of the target system.

Figure 5A:
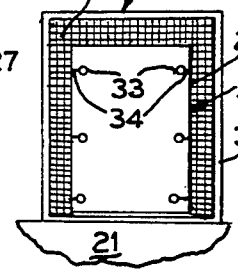
FIG. 5A is a front view of an alternate embodiment for supporting the target sheet of the invention with a backing screen.

In an alternate embodiment for mounting the target system shown in FIG. 5A, a support frame structure 31 has a mesh-like screen 33 mounted at a front face thereof. The target sheet 22 is then mounted to the screen such as by tie strings 34 passing through grommets 33 at edges of the sheet 22. It will be appreciated that the screen protects the sheet from being ripped when pummeled by pitched balls, since the target sheet lies directly on the face of the screen.

Figure 5B:
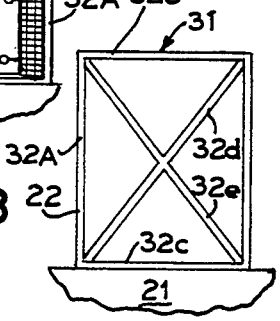
FIG. 5B is a side view of FIG. 5A.

FIG. 5B shows a side view with supporting members 32*a, b, c, d,* and *e* for the frame structure 31.

Although various minor changes and modifications might be proposed by those skilled in the art, it will be understood that I wish to include within the scope of the patent warrented hereon all such changes and modifications as reasonably come within my contribution to the art.

I claim as my invention:

1. A target training system for baseball pitchers, comprising:

a target sheet mounted on a supporting structure so that a facing surface of the target sheet is aligned substantially in a vertical plane and a bottom of the target sheet is at ground level;

hitter shoulder level, hitter waist level, and hitter knee level lines provided on said facing surface of said target sheet;

first and second vertical boundary lines running from a top to the bottom of the sheet for indicating a width of a strike zone; and a plurality of boxes of differing colors and having differing sequencing indicia representing relatively high quality pitches arranged in and around the strike zone, and wherein regions of a same color within and near the strike zone and exclusive of the colored boxes are provided, said regions being exclusionary zones representing relatively poor quality pitches.

2. The system of claim 1 wherein a vertically running line is provided running from top to bottom of the sheet at a center between the first and second vertical boundary lines.

3. The system according to claim 1 wherein at least some of the boxes contain sub-divisions defining smaller boxes within a larger box.

4. The system according to claim 3 wherein two boxes sub-divided from a larger box both have a same number indicia but are differentiated by a letter indicia.

5. The system according to claim 1 wherein the sequencing indicia comprise numbers, and wherein for all boxes lying to a left of a center line between the vertical boundary lines a different and unique sequencing identification indicia is provided in each box.

6. The system according to claim 5 wherein the sequencing identifying indicia comprise numbers.

7. The system according to claim 6 wherein at least some of the sequencing identifying indicia include letters.

8. The system according to claim 1 wherein the exclusionary zones are white.

9. The system according to claim 1 wherein the vertical first and second boundary lines comprise solid stripes and the shoulder, waist, and knee level lines are dashed lines.

10. The system according to claim 1 wherein the target sheet is a flexible material.

11. The system according to claim 1 wherein the flexible sheet comprises a material selected as one of the elements from the group consisting of canvas, polyester, and polyethylene.

12. The system according to claim 10 wherein the back surface of the flexible sheet has an attachment member for retaining the flexible sheet against a vertical support surface.

13. The system according to claim 12 wherein the attachment member comprises velcro.

14. The system according to claim 10 wherein the flexible sheet is mounted to a screen on a supporting frame.

15. The system according to claim 10 wherein grommets are provided for tying the flexible sheet to the screen.

16. The system according to claim 1 wherein the target sheet is flexible, and wherein the boxes of differing colors comprise patches of flexible material which are sewn onto the flexible sheet.

17. The system according to claim 1 wherein at waist level a box is provided overlapping the first vertical boundary line, and a second separate box is provided overlapping the second boundary line with no box being provided between these boxes at the waist level.

18. The system according to claim 1 wherein two of said target sheets are provided, a first of the target sheets having smaller boxes for use by higher skill level pitchers and a second of the target sheets having larger boxes for use by relatively medium skill level pitchers.

19. The system according to claim 18 wherein a third target sheet is provided having still larger boxes than the second target sheet, and wherein the first target sheet is for use by higher skill level pitchers, the second target sheet is for use by said medium skill level pitchers, and the third target sheet is used by lower skill level pitchers.

20. The target training system according to claim 1 wherein to the right of the second vertical boundary line and beginning at and extending to the right of the second vertical boundary line boxes for targets representing balls are provided with exclusionary zones provided between vertically adjacent boxes representing balls, and wherein ball boxes are also provided to the left of the first vertical boundary line and a same level and spacing as the ball boxes lying to the right of the second vertical boundary line.

21. A target training system for baseball pitchers, comprising:

a target sheet mounted on a supporting structure so that a facing surface of the target sheet is aligned substantially in a vertical plane and the bottom of the target sheet is at ground level;

hitter shoulder level, hitter waist level, and hitter knee level horizontal lines provided on said facing surface of said target sheet;

first and second vertical boundary lines running from a top to a bottom of the sheet for indicating a width of a strike zone, said strike zone being substantially above knee level and from a region below shoulder level; and a plurality of boxes each having differing identifying indicia arranged in spaced relationship from one another in and around the strike zone and wherein regions between the boxes within and adjacent to the strike zone representing exclusionary zones, said boxes comprising targets for relatively high quality pitches and said exclusion zones representing regions constituting relatively poor quality pitches.

22. A target training system for baseball pitchers, comprising:

a target sheet mounted on a supporting structure so that a facing surface of the target sheet is aligned substantially in a vertical plane and the bottom of the target sheet is at ground level;

first and second vertical boundary lines running from a top to a bottom of the sheet for indicating a width of a strike zone; and a plurality of boxes each having differing identifying indicia arranged in spaced relationship from one another in and around the strike zone and wherein regions are provided within the strike zone and adjacent to the strike zone representing exclusionary zones, said boxes comprising targets for relatively high quality pitches and said exclusion zones representing regions constituting relatively poor quality pitches.

23. A method for training baseball pitchers, comprising the steps of:

providing a sheet which extends from at ground level to above a hitter's shoulder level;

providing vertical strike zone boundary lines defining outer boundaries of a strike zone running from top to bottom on the sheet, and providing horizontal lines defining hitter shoulder level, waist level, and knee level which are useful for defining the strike zone;

providing a plurality of differently colored boxes having unique sequencing and identifying indicia thereon in and around the strike zone defined relative to the shoulder level, waist level, and knee level lines and vertical boundary lines; and identifying a target for the pitcher by designating at least one of a color and a sequencing indicia so as to define one of the boxes on the target sheet at which the pitcher aims.

24. A method according to claim 23 including the steps of providing the target sheet of a flexible material and attaching the target sheet at a surface of a wall.

25. A method according to claim 23 including the step of providing the target sheet as a flexible material and attaching it to a screen on a screen mounting structure, and positioning the screen mounting structure so that the pitcher can throw baseballs at the screen having the target sheet mounted thereon.

26. A method according to claim 23 including subdividing at least some of the boxes into box sub-divisions and training the pitcher by a sequence whereby the pitcher first throws for the box exclusive of the sub-division, and then as control improves the pitcher throws for one of the box sub-divisions.

27. A method according to claim 23 wherein the pitcher using the training system pitches for various boxes according to a desired sequence identified by the target sequencing indicia.

28. A method according to claim 27 including the step of providing the sequencing indicia as numbers.

* * * * *